United States Patent [19]

Sadigh-Behzadi

[11] Patent Number: 4,784,614

[45] Date of Patent: Nov. 15, 1988

[54] COMPONENTS HAVING MEANS FOR KEYED INTERCONNECTABILITY

[75] Inventor: Amir-Akbar Sadigh-Behzadi, Van Nuys, Calif.

[73] Assignee: Thomas & Betts Corporation, Bridgewater, N.J.

[21] Appl. No.: 103,096

[22] Filed: Sep. 30, 1987

[51] Int. Cl.[4] ..... H01R 13/64

[52] U.S. Cl. ..... 439/488; 439/680

[58] Field of Search ..... 439/488, 491, 677, 680; 434/259

[56] References Cited

U.S. PATENT DOCUMENTS

| | | | |
|---|---|---|---|
| 1,103,369 | 7/1914 | Montessori | 434/159 |
| 1,245,475 | 11/1917 | Lindheim | 434/159 |
| 1,784,236 | 12/1930 | Jones | 439/379 |
| 2,102,625 | 12/1937 | Hubbell, Jr. | 173/330 |
| 2,723,465 | 11/1955 | Silverstein | 35/35 |
| 2,839,843 | 6/1958 | Keyko | 35/35 |
| 2,971,275 | 2/1961 | Provenzano | 35/31 |
| 3,018,462 | 1/1962 | Barre, Jr. et al. | 339/112 |
| 3,023,394 | 2/1962 | Hubbell | 339/186 |
| 3,280,499 | 10/1966 | Studen | 46/17 |
| 3,307,374 | 3/1967 | Kirshbaum | 63/1 |
| 3,381,394 | 5/1968 | Munro | 35/31 |
| 3,510,964 | 5/1970 | Dahners et al. | 35/22 |
| 3,786,393 | 1/1974 | Conrad | 339/17 |
| 3,827,162 | 8/1974 | Moeser | 35/32 |
| 4,202,351 | 5/1980 | Biche | 128/696 |
| 4,704,091 | 11/1987 | Owens et al. | 439/491 |

FOREIGN PATENT DOCUMENTS

| | | | |
|---|---|---|---|
| 123590 | 10/1984 | European Pat. Off. | 439/680 |
| 1474721 | 2/1967 | France | 439/680 |

*Primary Examiner*—J. Patrick McQuade

*Attorney, Agent, or Firm*—Robert M. Roderick; Salvatore J. Abbruzzese

[57] ABSTRACT

A keying system, especially for use with intermateable electrical connector assemblies is disclosed. An electrical connector assembly includes first and second interconnectable electrical connectors. The first connector includes a first keying means formed into a raised pattern of letters identifying a particular color. The mating second connector is colored the particular color and includes a pattern of cavities corresponding to the pattern of letters. The second connector accommodates the first connector in singular unique orientation, with the color of the second connector easily visually identifying the mateability of the first connector thereto.

13 Claims, 2 Drawing Sheets

COMPONENTS HAVING MEANS FOR KEYED INTERCONNECTABILITY

FIELD OF THE INVENTION

This invention relates generally to components having keying means thereon to permit matching of one component with another and more particularly the present invention relates to electrical connectors including keying elements which permit electrical connectors to be properly matched and interconnected.

BACKGROUND OF THE INVENTION

Often there is need to match pairs of various similarly constructed components together. Examples of such matching pairs can be as simple as those used in childrens' toys or as complex as electronic components. Pairs of components such as these are often characterized as being comprised of a male and a female member. That is, one component of the pair, the male member, is interfittable into the other component of the pair, the female member. As may be appreciated, in more complex elements such as electronic components and more particularly electrical connectors, it is necessary to assure that proper keying of the components of the pair is achieved. The art, especially the electrical connector art, has seen a wide variety of techniques for matching together connectors which are to be mated to one another. These techniques include, for example, interfitting parts such as matching protrusions and recesses, corresponding indicia such as numbering or lettering, and color coding in general where pairs of connectors are uniquely color coded to provide a visual indication of mateability. Each of these keying techniques has various advantages and disadvantages.

In working with sensitive electronic components such as integrated circuits, semiconductor chips and connectors therefor, it is imperative that first, the proper components be matched with one another and second, the matched components be interconnected in the correct position. Further, as electronic assemblies using such electronic components are typically mass produced, assembly speed is essential so as to keep labor and assembly costs to a minimum. Thus any keying technique used would have to be readily identifiable so that components can be quickly matched. One example of such an assembly is where numerous electrical connectors must be matched to mating connectors supported on a printed circuit board. While speed is essential in order to minimize labor costs, there is no margin for error, as an incorrectly mated connector pair could cause significant damage to an electronic apparatus in which the pair is used. While mechanical keying elements, such as uniquely shaped protrusions and recesses, provide such fool-proof connection, they are not easily visually identifiable, thus reducing the speed at which an installer can operate. Color coding on the other hand, increases visual recognition thereby increasing the speed of installation, but color coding alone would not be absolutely fool-proof.

It can be seen that a combination of color coding and mechanical keying elements would provide increased speed and fool-proof mateability. However, if color coding is provided in a secondary manufacturing operation, it would greatly increase the cost of the components. Color coding could be embodied in the component during manufacturing thereof, such as by molding the component from a material of a particular color.

However, due to mechanical and electrical constraints dictated by function and design, some electronic components must be formed from materials which cannot be color coded. Thus an installer would have to rely on the mechanical keys designed into the component without having the readily visually recognizable color to distinguish one component from another.

Accordingly, it is desirable to provide a keying technique which is easily visually identifiable to the installer and yet provides for fool-proof interconnectability of components where one or more of the components are not subject to color coding.

SUMMARY OF THE INVENTION

It is, therefore, an object of the present invention to provide an improved technique for keying mating components.

It is a further object of the present invention to provide components which include keying members thereon which are easily visually identifiable and provide fool-proof intermateability of the components.

It is a still further object of the present invention to provide electronic components having visually identifiable keying elements thereon and which would prevent improper connection of component pairs.

In the efficient attainment of the foregoing and other objects, the present invention provides an assembly of matched interconnectable components including at least one pair of a first component and a second component component includes first keying means including a raised pattern of letters. The letters visually identify a particular color. The second component includes second keying means which interfittingly engages the raised pattern of letters of the first keying means. The second component would be color coded so as to correspond to the particular color identified by the raised pattern of letters on the first component to thereby provide a visual indication of the matched interconnectability of the first and second components.

As shown by way of a preferred embodiment herein, the present invention provides an electrical connector assembly comprising a first connector housing supporting a plurality of electrical contacts, and a second connector housing supporting a second plurality of electrical contacts. The first connector housing is designed to mechanically and electrically connect to the second housing. The first housing includes a first mating element which is formed into a configuration which visually identifies a particular color. The second connector housing includes a second mating element which is formed so as to mechanically accomodate the first mating element of the first housing. The second mating element of the second housing is color coded to identify the particular color identified by the configuration of the first mating element.

DETAILED DESCRIPTION OF THE PREFERRED EMBODIMENT

Figure 1:
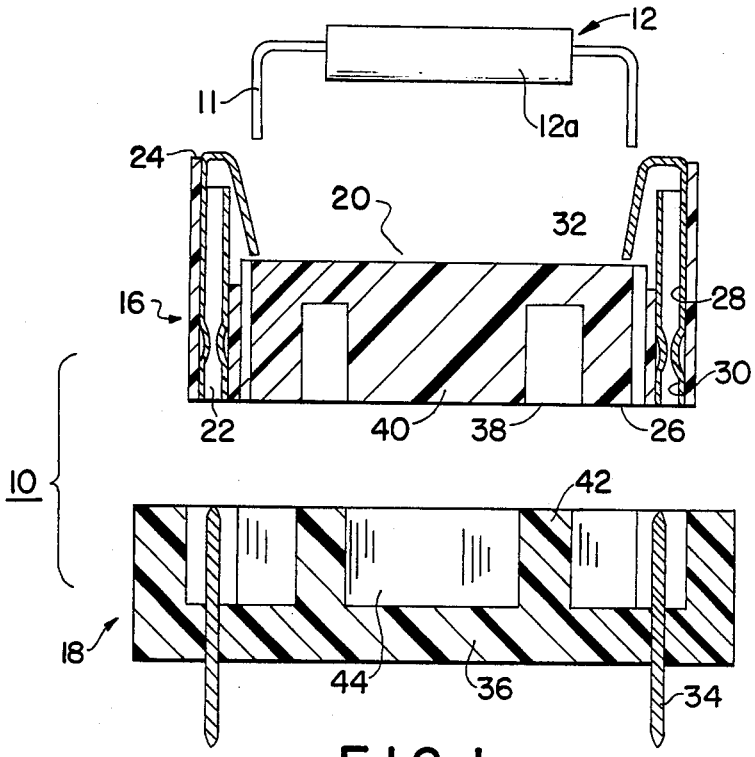
FIG. 1 is an exploded sectional showing of an electrical connector assembly employing the keying technique of the present invention.
Figure 2:
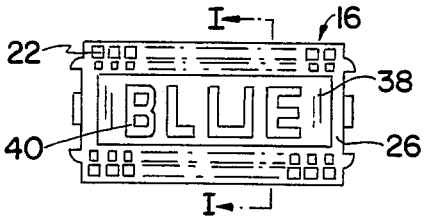
FIG. 2 is a bottom perspective showing of a socket connector of the connector assembly shown in FIG. 1.
Figure 3:
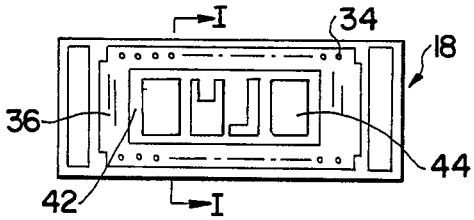
FIG. 3 is a top perspective showing of the header connector of the connector assembly of FIG. 1.

Referring to FIGS. 1 through 3, an electrical connector assembly 10 of the present invention is shown. Connector assembly 10 is designed to connect an integrated circuit (IC) 12 to a printed circuit board (PCB) 14 shown in FIG. 6. Integrated circuit 12 may be any conventional IC, including a semiconductor body 12*a* and a plurality of depending electrical leads 11. IC 12 is known as a DIP integrated circuit having leads 11 arranged in two longitudinally aligned rows.

The connector assembly 10 of the present invention includes a connector socket 16 which accommodates the IC 12 and a connector header 18 which mounts to PCB 14 (FIG. 6) and accommodates socket 16 therein. A cover (not shown) may be used to secure IC 12 in socket 16.

Socket 16 is of conventional construction and includes an elongate rectangular body having a substantially open central section 20 and two rows of longitudinally spaced apertures 22 extending between an upper face 24 and a lower face 26. Each aperture 22 accommodates an electrical terminal 28 therein. Electrical terminal 28 includes a lower socket portion 30 and a contact portion 32 which extends into the open section of 20 of socket 16. The integrated circuit 12 may be inserted into the open section 20 of socket 16 so that the leads 11 electrically engage the contact portions 32 of electrical terminals 28.

Header 18 is an elongate member having a rectangular body of mating shape to socket 16. Header 18 is generally an open ended cup-shaped member including a pair of longitudinally aligned, transversely spaced extending rows of contact pins 34. Pins 34 are elongate members which are press-fitted or otherwise secured in a bottom wall 36 of header 18. Pins 34 are positioned in header 18 such that when socket 16 is inserted therein, the pins 34 will be accommodated in the socket portions 30 of electrical terminals 28. Thus upon insertion of socket 16 into header 18, electrical connection will be established between the header pins 34 and the integrated circuit 12. Socket 16, header 18 and its associated conductive components, terminals 28 and pins 34, are shown only by way of example. Any other type of connector structure could also be used in accordance with the present invention.

Figure 6:
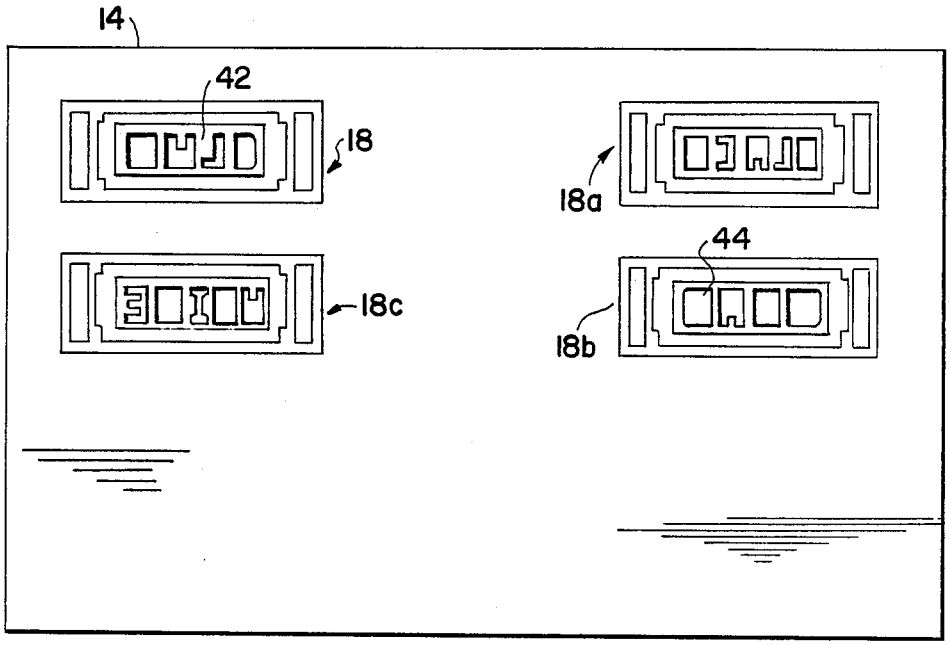
FIG. 6 shows, in perspective, a printed circuit board supporting a plurality of header connectors of FIG. 1.

As additionally shown in FIG. 6, quite often many headers 18 are mounted to a printed circuit board 14. In order to assure that the proper socket 16 is connected to its mating header 18, the present invention provides a color-coded keying technique to prevent incorrect matching of sockets to headers. As above mentioned, simply color coding socket 16 and header 18 would achieve such visual recognition of matched components. In the present invention, color coding the socket 16 to match the header 18 is not possible during manufacture of these components due to the type of material from which each is formed. Header 18 may be formed of any easily color codeable insulative plastic, such as polyester. However, electrical and mechanical design contraints of many applications dictate that socket 16 be formed of a different material, such as polypheneylene sulfide or some other reinforced thermoplastic, which is not susceptible to color coding during manufacture. Thus while each of the headers 18 shown in FIG. 6 can be colored a different color, such as red, blue, green, etc., the socket 16 could not be colored so as to correspond to the colors of the headers 18. Accordingly, in these instances, the connector assembly 10 could not avail itself of simple color coding to facilitate matching of one component to another. In the present invention a keying system is provided which is easily visually recognizable and yet can be employed with components which cannot be color coded.

Referring additionally to FIG. 2, the undersurface 38 of socket 16 is shown. Extending from undersurface 38, is a pattern of raised alphabetic letters 40 which are formed to spell out a particular primary color. In the instance shown in FIG. 2, the pattern of raised letters 40 spell out the word "BLUE". Thus while the socket 16 itself is colored some color other than blue, as is dictated by the material from which the socket is formed, the pattern of raised letters 40 provides an instant visual indication of its associated color, in the present instance blue.

Turning to FIG. 3, the lower face 36 of header 18 is shown. Header 18 includes an upwardly extending series of walls 42 which define therebetween a pattern of cavities 44 which closely approximate the general outline of the pattern of letters 40 of socket 16. The pattern formed by cavities 44 are constructed to accommodate in interfitting relationship, the pattern of letters 40 of socket 16. The cavities 44 of header 18 are constructed to be shaped into a general outline of the reverse image of the raised pattern of letters 40 of socket 16. As shown in FIG. 3, the cavities 44 need not exactly conform to the reverse image of each letter of the raised pattern of letters 40, as the pattern of cavities 44 need not be readily visually readable, since the header 18 itself may be colored any particular color. In the example shown in FIGS. 2 and 3, header 18 would be formed of a plastic material which is colored blue. Thus it is readily recognizable that the socket 16 is connectable to the header 18.

Figure 5:
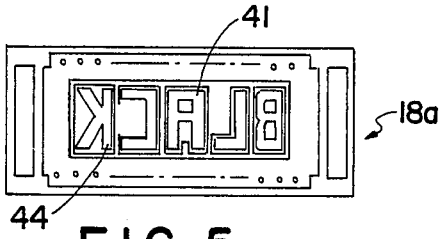
FIG. 5 is a top perspective showing of a further embodiment of a header connector of FIG. 3.

In order to further provide visual indication of mateability an additional mating feature, especially helpful for color-blind persons, may also be incorporated into the header design. As shown in FIG. 5, header 18*a* may include reverse image letters 41 molded into the base of cavities 44 which identify the particular color of the header 18*a*. In the embodiment shown in FIG. 5, the letters B-L-A-C-K are formed at the base of the cavities 44. The socket 16*a* may therefore be matched to header 18*a* by color or by words.

The particular shape of the letters forming the pattern of letters 40 of socket 16 is uniquely interfittable into the pattern of cavities 44 of header 18 in only one particular orientation. Thus in addition to providing a keying feature which uniquely keys the socket 16 of FIG. 2 to the header 18 of FIG. 3, the arrangement of letters 40 and cavities 44 also provides a polarization feature which prevents the socket 16 from being inserted into the proper header 18 in an incorrect position. This is required in most electrical connector applications. As shown in FIGS. 2 and 3, the socket 16 is properly inserted into the header 18 by inverting the socket 16 left to right from its position shown in FIG. 2. In such inverted position, socket 16 may be inserted into header 18 as it is shown positioned in FIG. 3.

Figure 4:
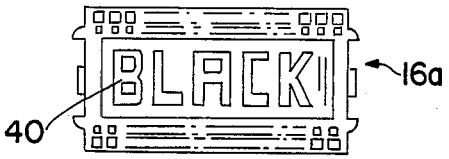
FIG. 4 is a bottom perspective showing of a further embodiment of the socket connector of FIG. 2.

Referring additionally to FIGS. 4 and 5, one of many alternative keying arrangements is shown. By comparing the socket 16 of FIG. 2 with the header 18*a* of FIG. 5, it can be seen that socket 16 could not be connected to header 18*a*. A similar relationship is shown between the socket 16*a* of FIG. 4 and the header 18 of FIG. 3. Other color-coded combinations, such as those suggested in FIG. 6, can be readily appreciated.

Referring additionally to FIG. 6, a printed circuit board 14 is shown, onto which is mounted four headers 18, 18*a*, 18*b*, and 18*c* of the type described herein. Each of the headers are of identical construction except for the raised walls 42 forming a different pattern of cavities 44 in each. Header 18*a* would be formed of a plastic material colored black and would accommodate a socket 16*a* which has a raised pattern of letters 40 spelling out the word "BLACK" (FIG. 4). Similarly, headers 18*b* and 18*c* would be formed of plastic material colored grey and white respectively to accommodate sockets 16*b* and 16*c* (not shown) with patterns of raised letters spelling out the words "GREY" and "WHITE" respectively. The color code keying feature of the present insertion could not be defeated as the socket 16 having raised letters 40 forming the word "BLUE" (FIG. 2) would not fit into any of headers 18*b*, 18*c*, or 18*d*.

It can be appreciated that an installer working with printed circuit board 14 can easily determine which sockets are insertable into their mating headers. By matching the printed words on each socket 16 with the color of the header 18, an indication of proper mateability is readily provided.

While the present invention is particularly useful with electrical connectors, it is of course contemplated that the keying system described herein would not be limited to electrical connectors and could be applied to any situation where keyed accommodation of mating parts is required.

Various changes to the foregoing described and shown structures would now be evident to those skilled in the art. Accordingly, the scope of the invention is set forth in the following claims.

I claim:

1. An assembly of matched interconnectable components comprising:

a first component; and a second component constructed for interconnection with said first component;

said first component having first keying means including a raised pattern of letters, said letters identifying a particular color;

said second component having second keying means which interfittingly engages said raised pattern of letters of said first keying means;

said second component being color coded so as to correspond to the particular color identified by said raised pattern of said first component, to thereby provide a visual indication of the matched interconnectability of said first and second components.

2. An assembly of claim 1 wherein said second keying means includes at least one cavity which accomodates said raised pattern of letters of said first keying means.

3. An assembly of claim 2 wherein said cavity is formed into a pattern complementary to said pattern of letters of said first component.

4. An assembly of claim 2 wherein said keying means includes a plurality of cavities constructed to be complementary to said raised pattern of letters of said

5. An assembly of claim 2 wherein said second keying means accommodates said raised letters of said first keying means in singular unique orientation.

6. An assembly of claim 2 wherein said first component is colored a different color than said second component.

7. An electrical connector assembly comprising:

a first electrical connector having a first insulative housing supporting a plurality of first electrical contacts;

a second electrical connector, said second connector being connectable to said first connector and including a second insulative housing supporting a plurality of second electrical contacts, said first contacts being electrically connectable to said second contacts;

a first mating element on said first housing being formed into a configuration to identify a particular color;

a second mating element on said second housing, said second mating element being intermateable with said first mating element, said second mating element being color coded said particular color.

8. An electrical connector assembly of claim 7 wherein said first mating element includes plural projections formed into alphabetic shapes in configuration such that said particular color is identified.

9. An electrical connector assembly of claim 8 wherein said second mating element includes plural recesses which accommodate the projections of said first mating element.

10. An electrical connector assembly of claim 9 wherein said first mating element and said second mating element provide for polarized mating of said first and second connector.

11. An electrical connector assembly of claim 7 wherein said first mating element is colored a color other than said particular color.

12. An electrical connector assembly of claim 11 wherein said second housing is colored said particular color.

13. An electrical connector assembly of claim 12 wherein said first housing is colored said color other than said particular color.

* * * * *